US007378134B2

(12) United States Patent
Narita et al.

(10) Patent No.: US 7,378,134 B2
(45) Date of Patent: May 27, 2008

(54) METHOD OF FORMING HIGH TEMPERATURE CORROSION RESISTANT FILM

(75) Inventors: Toshio Narita, Hokkaido (JP); Shigenari Hayashi, Hokkaido (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 77 days.

(21) Appl. No.: 10/544,743

(22) PCT Filed: Feb. 9, 2004

(86) PCT No.: PCT/JP2004/001347

§ 371 (c)(1),
(2), (4) Date: Jun. 2, 2006

(87) PCT Pub. No.: WO2004/070077

PCT Pub. Date: Aug. 19, 2004

(65) Prior Publication Data

US 2007/0116894 A1 May 24, 2007

(30) Foreign Application Priority Data

Feb. 10, 2003 (JP) ..... 2003-031880

(51) Int. Cl.
*C23C 10/42* (2006.01)

(52) U.S. Cl. ..... 427/594; 427/593; 427/252; 427/202; 427/205

(58) Field of Classification Search ..... 427/182, 427/185, 191–192, 195, 562, 565, 568, 591, 427/594, 592, 202, 205, 252
See application file for complete search history.

(56) References Cited

U.S. PATENT DOCUMENTS 3,925,570 A * 12/1975 Reinke et al. ..... 427/591
4,745,002 A * 5/1988 Vexler et al. ..... 427/591

FOREIGN PATENT DOCUMENTS

| | | |
|---|---|---|
| JP | 40-9603 | 5/1965 |
| JP | 2-254149 | 10/1990 |
| JP | 02-254149 | * 10/1990 |
| JP | 5-171407 | 7/1993 |
| JP | 2000-282217 | 10/2000 |

* cited by examiner

*Primary Examiner*—Frederick J Parker
(74) *Attorney, Agent, or Firm*—Westerman, Hattori, Daniels & Adrian, LLP.

(57) ABSTRACT

Disclosed is a method of forming a high-temperature corrosion-resistant film, which comprises placing a container containing a film-forming fine powder and a target member capable of being heated by an electric current heating process, in an atmosphere-controllable treatment chamber, and floating the fine powder and subjecting the target member to the electric current heating process to allow vapor of the fine powder generated by the heating to be diffused into the target member from a surface thereof so as to form a diffusion film layer, and allow the floated fine powder to be attached onto the surface so as to form a fine-powder film layer on the diffusion film layer. The target member may be masked to form the film only in a non-masked region of the target member. Alternatively, a specific region of the target member may be cooled at a temperature precluding the film formation to prevent the film from being formed in the specific region. The method of the present invention makes it possible to form a high-temperature corrosion-resistant film having an "intended configuration" in a "desired region" of a heat-resistant material at "low cost" with "high productivity".

5 Claims, 1 Drawing Sheet

METHOD OF FORMING HIGH TEMPERATURE CORROSION RESISTANT FILM

TECHNICAL FIELD

The present invention relates to a method of forming a high-temperature corrosion-resistant film with a bilayer structure consisting of a diffusion film layer and a fine-powder film layer, on a target member to be treated. The present invention also relates to a method of forming the high-temperature corrosion-resistant film in an arbitrary region of the target member.

BACKGROUND ART

Generally, a heat-resistant material to be activated at a high temperature is protected from a high-temperature corrosive environment by forming and maintaining a protective scale, such as $Cr_2O_3$, $Al_2O_3$ or $SiO_2$. This scale causes deterioration in mechanical characteristics of the heat-resistant material, and thereby an element for forming the protective scale, such as Cr, Al and/or Si, cannot be practically added in a sufficient amount.

Currently, a film containing a high concentration of Cr, Al and/or Si is formed on a surface of a heat-resistant material through various processes. For example, a Ni-based superalloy for use in gas turbines, jet engines, etc., has an Al or Cr diffusion film formed through a pack cementation process, a CVD process, etc., or a MCrAlY film formed through a thermal spraying process, an EBPVC process, etc.

Among the above film forming processes, while the thermal spraying process is capable of forming a film onto a large area at low cost, it can be applied only to a member having a relatively simple configuration. While a sputtering process or a PVD process is capable of accurately forming a film, it has restrictions on size and productivity and leads to increase in cost.

Further, these processes have difficulty in forming a film in a through-hole or a gap. While the CVD process or the pack cementation process designed to supply an element for forming a film, or a film-forming element, in the form of gas is capable of forming a film even onto a member having a complicated configuration and in a through-hole or a gap, it is based on atmosphere control. Thus, the CVD process or the pack cementation process is restricted in size of a target member, and inferior in productivity and cost performance. Moreover, a film is generally formed over the entire surface of the member, or it is difficult to selectively form a film only in a specific region of the member.

A film forming process capable of solving the above characteristics and disadvantages includes a plating process. The plating process is typically designed to electrochemically deposit a film from an aqueous solution, and theoretically capable of forming a film onto a region allowing an electrolytic solution to enter thereinto. Further, a nonaqueous solution or a molten salt can be used in the plating process to form a film of a base metal, such as Al or Mg. In addition, a surface of a target material can be masked to selectively form a film only in a specific region of the surface.

However, the plating process has restrictions on a combination and composition control of film-forming elements, and an obtained product is generally required to be subjected to a heat treatment at a high temperature so as to ensure adhesion of the formed film.

A member to be used at a high temperature is not exposed to the high temperature in its entirety. For example, in a sheath of a thermocouple, while the edge of the sheath is exposed to high-temperature combustion gas, a large portion of the sheath is maintained in a low temperature range. Further, if a film is formed on the entire surface of the sheath, the film formed on a specific region, such as a mounting region or a connection region, has to be removed in a subsequent process. Typically, these specific regions are maintained at a low temperature during use.

Thus, it is unnecessary to form a film over the entire surface of a member, and it is rather desired to selectively form a film only in a specific region to be exposed to a high-temperature corrosive circumstance.

In a process for forming a film excellent in high-temperature corrosion resistance in a specific region having a complicated configuration, the existing film forming processes have the following advantages and disadvantages. The thermal spraying process, the PVD process or the sputtering process can form a film onto a specific region by use of a masking technique. However, these processes cannot form a film on a region in a through-hole or a gap. The CVD process or the pack cementation process can form a film onto a region in a through-hole or a gap. However, these processes have restrictions on film formation only in a specific region. The plating process can form a film on a region in a through-hole or a gap and on a specific region by use of a masking technique. However, a product from the plating process is generally required to be subjected to an after-heat treatment for ensuring the adhesion between a base material and a formed film. Moreover, the plating process has restrictions on a type and composition control of film-forming elements.

Thus, there is the need for developing a process of forming a high-temperature corrosion-resistant film having an "intended configuration" in a "desired region" of a heat-resistant material at "low cost" with "high productivity".

DISCLOSURE OF THE INVENTION

Means for Solving the Problem

The present invention provides a dry process capable of forming a film excellent in high-temperature corrosion resistance, on a surface of a target member, particularly on a surface of a heat-resistant material. The present invention is characterized by utilizing a floating phenomenon of fine particles induced by vibration, and an electric current heating process. A constituent element of the film is not limited to a specific element, and the film may be a composite film containing a compound.

Specifically, the present invention provides (1) a method of forming a high-temperature corrosion-resistant film, which comprises placing a container containing a film-forming fine powder and a target member capable of being heated by an electric current heating process, in an atmosphere-controllable treatment chamber, and floating the fine powder and subjecting the target member to the electric current heating process to allow vapor of the fine powder generated by the heating to be diffused into the target member from a surface thereof so as to form a diffusion film layer, and allow the floated fine powder to be attached onto the surface so as to form a fine-powder film layer on the diffusion film layer.

In the method (1) of the present invention, (2) the fine powder may be floated by vibrating the target member and/or the container containing the fine particles.

In the method (1) or (2) of the present invention, (3) the fine powder may be at least one selected from the group consisting of (I) an element capable of forming a protective oxide scale, which includes Al, Cr and Si, (II) a refractory metal element excellent in diffusion barrier characteristics, which includes Re, W and Mo, (III) a rare-earth element capable of providing improved adhesion in an oxide scale and (IV) a platinum group element capable of contributing to mechanical characteristics of the film.

Either one of the methods (1) to (3) of the present invention may include (4) masking a portion of the target member to form the film only in a non-masked region of the target member.

Either one of the methods (1) to (3) of the present invention may include (5) cooling a specific region of the target member at a temperature precluding the film formation to prevent the film from being formed in the specific region.

Either one of the methods (1) to (5) of the present invention, the target member may be a resistive heat-generating element.

BEST MODE FOR CARRYING OUT THE INVENTION

A material capable of being heated by an electric current heating process and applicable to a method of the present invention primarily includes a heat-resistant metal, such as Ni, Fe or Co, a heat-resistant alloy material, a platinum group element, such as Pt, Ir or Rh, and a heat-resistant material, such as conductive ceramics.

Figure 1:
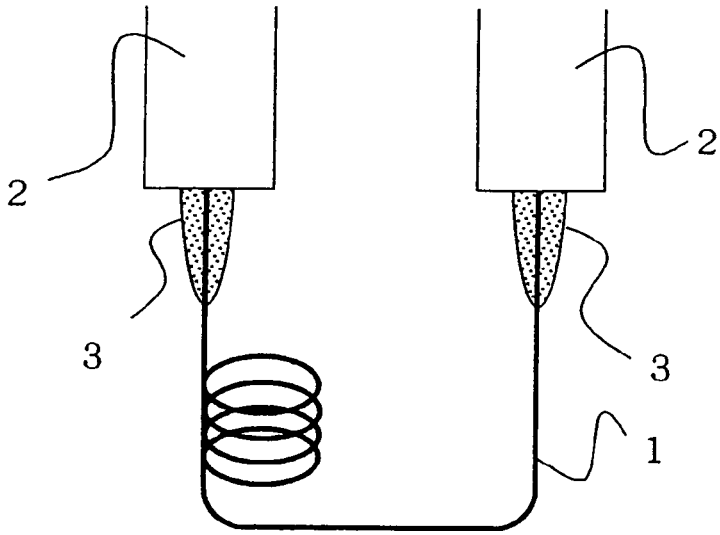
FIG. 1 is a conceptual diagram showing a wire which is being masked through a method of the present invention.

In advance of implementing the method of the present invention, a target member formed in an intended configuration is firstly prepared. FIG. 1 shows one example in which a wire 1 is used as the target member. A pair of terminals 2, 2 are connected, respectively, to opposite ends of the wire 1 or the target member to supply an electric current to the wire 1 therethrough. When a film is formed on a part of the surface of the wire, a region to be formed with the film is exposed, and the remaining region is masked by heat-resistant ceramics cements 3, 3 or the like. The masking means is not limited to a specific covering method, but may be any suitable method, such as a method of coating a surface with heat-resistant ceramics cement, a method of covering a surface by a ceramics pipe, or a method of covering a surface by a ceramics cloth. In place of the masking technique, a region having no need to be formed with the film may be cooled at a temperature less than that allowing the film to be formed.

A pair of current-supply electrodes may be disposed adjacent to a specific region to be formed with the film, so as to allow only the specific region to be heated.

Figure 2:
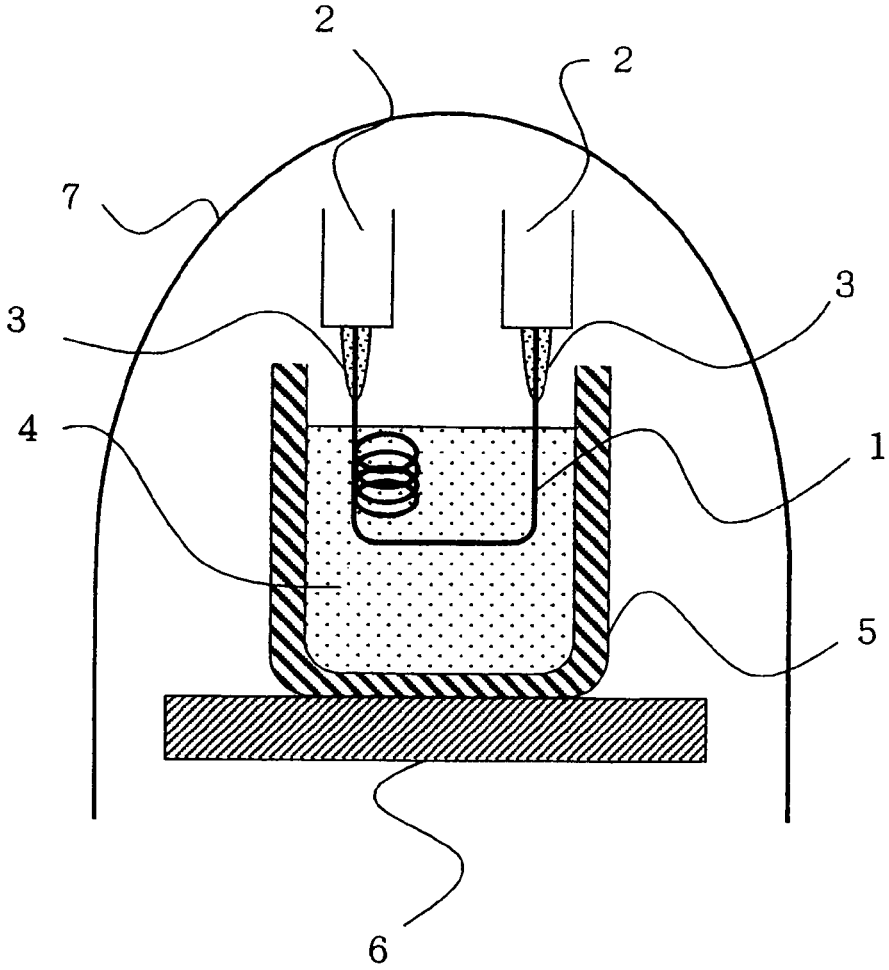
FIG. 2 is a conceptual diagram showing a masked wire which is being heated and subjected to a diffusion treatment and a fine-powder attaching treatment.

Subsequently, as shown in FIG. 2, a film-forming fine powder 4 is put in a container 5, such as a crucible, and the wire 1 or the target member is immersed in the fine powder 4. Then, the container 5 is placed on a table 6 equipped with a vibrating mechanism (not shown). Preferably, the fine powder 4 has an average particle size ranging from 0.1 to 5 μm. This table 6 is placed in an atmosphere-controllable treatment chamber 7, such as a vacuum chamber, and an air in the treatment chamber 7 is evacuated therefrom. Preferably, the treatment chamber 7 is maintained in a degree of vacuum of about $10^{-3}$ Pa. The treatment chamber 7 may have a high-purity inert gas atmosphere.

When the treatment chamber 7 has an inert gas atmosphere, a material for accelerating vaporization of the film-forming fine powder, such as $NH_4Cl$, may be added thereto. After the degree of vacuum in the treatment chamber 7 reaches a predetermined value, a given current is supplied to the wire 1 or the target member to heat the wire 1. During this electric current heating process, the target member and/or the container containing the fine powder are vibrated to allow the fine powder or fine particles to be floated in the container.

The exposed region of the target member is heated to a high temperature by the current supply. Due to this heat, the fine powder is heated and emitted in the form of vapor. This vapor comes into collision with the exposed surface of the target member to cause alloying between the target member and the fine powder components. Then, the fine powder components are diffused into the target member to form a diffusion film layer.

Simultaneously, a part of the floated fine powder is attached onto the exposed region of the target member to form a fine-powder layer. The particle layer of the fine powder components attached on the exposed surface brings out a function of a high-temperature corrosion-resistant film. Otherwise, if no vibration is applied, only the diffusion film layer will be formed by the vaporization of the fine powder components, but any high-temperature corrosion-resistant film having the attached fine powder will not be formed.

The atmosphere may be controlled to induce a reaction between the atmosphere gas and the fine powder components so as to form and attach a compound fine-particle film on the exposed surface.

The material of the film-forming fine powder may comprise: an element capable of forming a protective oxide scale (Al, Cr, Si, etc.); a refractory metal element excellent in diffusion barrier characteristics (Re, W, Mo, etc.); a rare-earth element capable of providing improved adhesion in an oxide scale (Y, La, Ce, etc); a platinum group element capable of contributing to mechanical characteristics of the film (Pt, Rh, Ir, Ru, etc); an inorganic compound ($Al_2O_3$, SiC); and/or a intermetallic compound (NiAl). Al, Cr or Si is a representative metal having a high vapor pressure, and an alloy thereof may also be used. Re, Mo or W can be used as a typical element capable of forming an oxide having a high sublimation pressure.

EXAMPLE

The film forming method of the present invention will be described in more detail below in connection with examples.

Inventive Example 1

A Ni wire (φ 0.5 mm) was prepared as a target member, and formed in a configuration of a resistive heat-generating element. A pair of current-supply terminals were connected, respectively, to opposite ends of the wire, and then a part of the wire on the side of the terminals was covered by heat-resistant ceramics cement.

Then, an alumina crucible was used as a container for containing a fine powder, and a Cr powder (average particle size: 5 μm) serving as the fine powder was put in the crucible. The Ni wire was then immersed in the Cr powder, and the crucible was placed on a table equipped with a vibrating mechanism. This table was placed in a vacuum chamber, and an air in the chamber was evacuated to allow the chamber to have a degree of vacuum of about $10^{-3}$ Pa. Then, the crucible was vibrated (vibrational amplitude: 1.0 mm, vibration frequency: 60 times/sec), and the Ni wire was simultaneously subjected to an electric current heating process. After the electric current heating process, the Ni wire was naturally cooled.

In a section of the treated Ni wire, a Cr diffusion film and Cr particles attached on a surface of the film were observed. As seen in this result, the Cr powder applied with the vibration is supplied onto the exposed surface of the Ni wire in the form of Cr vapor and floated Cr particles.

Comparative Example 1

Except that the crucible was kept in a stationary state, the Ni wire was subjected to the electric current heating process under the same conditions as those in Inventive Example 1. In a section of the treated Ni wire, only a Cr diffusion film layer formed in the treated Ni wire was observed.

Inventive Example 2

Except that a Re powder (average particle size: 5 μm) was used as the fine powder, the Ni wire was subjected to the electric current heating process under the same conditions as those in Inventive Example 1. In a section of the treated Ni wire, a Re diffusion film and Re particles attached on a surface of the film were observed. As seen in this result, the Re powder applied with the vibration is supplied onto the exposed surface of the Ni wire primarily in the form of floated particles.

Comparative Example 2

Except that the crucible was kept in a stationary state, the Ni wire was subjected to the electric current heating process under the same conditions as those in Inventive Example 2. In a section of the treated Ni wire, no Re diffusion film was observed. This would be caused by a low vapor pressure of Re.

Inventive Example 3

Except that a mixed powder (Re powder+10 weight % of $ReO_2$ powder, each having an average particle size of 5 μm) was used as the fine powder, the Ni wire was subjected to the electric current heating process under the same conditions as those in Inventive Example 1. In a section of the treated Ni wire, a Re diffusion film and Re particles attached on a surface of the film were observed. As seen in this result, the mixed powder applied with the vibration is supplied onto the exposed surface of the Ni wire in the form of floated Re particles and floated $ReO_2$ particles, and both $ReO_2$ vapor and $ReO_2$ particles are reduced to Re on the exposed surface of the Ni wire.

Comparative Example 3

Except that the crucible was kept in a stationary state, the Ni wire was subjected to the electric current heating process under the same conditions as those in Inventive Example 3. In a section of the treated Ni wire, only a Re diffusion film formed in the treated Ni wire was observed. That is, while Re moved in the form of $ReO_2$ vapor was reduced to Re on the exposed surface of the Ni wire, and diffused into the Ni wire, no $ReO_2$ particle layer was formed.

INDUSTRIAL APPLICABILITY

The method of the present invention makes it possible to protect a heat-resistant material to be activated by exposure to high-temperature combustion gas, from a high-temperature corrosive circumstance. In addition, the method of the present can readily provide a member having a protective film selectively formed in a specific region thereof to be exposed to a high-temperature corrosive circumstance.

What is claimed is:

1. A method of forming a combustion gas corrosion-resistant film, comprising:

preparing film-forming fine powders of mean particle diameter of 0.1-5 μm, said fine powders are of at least one selected from (I) Al, Cr, Si, (II) Re, W, Ta, Mo, Mb, (III) Y, La, Ce, (IV) Pt, Rh, Ir, Ru, (V) $Al_2O_3$, SiC, (VI) NiAl intermetallic compound;

preparing a target member capable of being heated by an electric current heating process, said target member made of a heat resistant material selected from the group of Ni, Co, Fe, Pt, Ir, Rh, and conductive ceramics;

placing a container containing said fine powders and said target member in a controlled atmosphere;

floating said fine powders;

heating said target member by the electric current heating process so as to generate vapor of said fine powders by the heating to have the vapor hit a surface of said target member and diffuse into said target member from said surface thereby forming a diffusion film layer, and so as to have said floated fine powders to attach onto said surface thereby forming a fine-powder film layer on said diffusion film layer, wherein said diffusion film layer and said fine-powder film layer forms a dual-film layer structure.

2. The method as defined in claim 1, wherein said fine powders are floated by vibrating said target member and/or said container containing the fine powders.

3. The method as defined in claim 1, which includes masking a portion of said target member to form said film only in a non-masked region of said target member.

4. The method as defined in claim 1, which includes cooling a specific region of said target member at a temperature precluding the film formation to prevent said film from being formed in said specific region.

5. The method as defined in claim 1, wherein said target member is a heat-generating electric resistance element.

* * * * *